US007334572B1

(12) United States Patent
Diggs et al.

(10) Patent No.: US 7,334,572 B1
(45) Date of Patent: Feb. 26, 2008

(54) SYSTEM AND METHOD FOR SECURING FUEL INJECTORS

(75) Inventors: Matthew Diggs, Farmington, MI (US); Jeff Fluharty, Woodhaven, MI (US); Robert Yambasky, Livonia, MI (US); Mark Googasian, Rochester Hills, MI (US); Michael Schrader, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/668,534

(22) Filed: Jan. 30, 2007

(51) Int. Cl.
*F02M 61/14* (2006.01)

(52) U.S. Cl. ..... 123/470; 123/195 C; 123/90.38; 123/469

(58) Field of Classification Search ..... 123/470, 123/195 C, 90.38, 469
See application file for complete search history.

(56) References Cited

U.S. PATENT DOCUMENTS

| | | | | |
|---|---|---|---|---|
| 3,824,971 | A * | 7/1974 | Skatsche et al. | 123/302 |
| 4,149,496 | A | 4/1979 | Palma | |
| 5,499,612 | A * | 3/1996 | Haughney et al. | 123/470 |
| 5,699,770 | A * | 12/1997 | Matsumoto et al. | 123/470 |
| 5,878,719 | A | 3/1999 | Nakagomi | |
| 5,899,190 | A | 5/1999 | Nakagomi et al. | |
| 6,269,798 | B1 | 8/2001 | Takahashi et al. | |
| 6,298,814 | B1 * | 10/2001 | Pearlman et al. | 123/90.38 |
| 6,408,808 | B1 * | 6/2002 | Yi | 123/90.27 |
| 6,843,217 | B2 * | 1/2005 | Zwick et al. | 123/143 C |
| 6,877,491 | B2 * | 4/2005 | Hanawa et al. | 123/533 |
| 2004/0040542 | A1 | 3/2004 | Heinrich | |
| 2005/0121002 | A1 | 6/2005 | Nakamura | |

FOREIGN PATENT DOCUMENTS

| | | |
|---|---|---|
| GB | 875438 | 8/1961 |
| JP | 10-176629 | 6/1998 |

* cited by examiner

*Primary Examiner*—Stephen K. Cronin
*Assistant Examiner*—J. Page Hufty
(74) *Attorney, Agent, or Firm*—Diana Brehob; Bir Law, PLC; David Bir

(57) ABSTRACT

A system and method for securing a fuel injector in an internal combustion engine include a clamp for securing adjacent injectors to a cylinder head. The clamp includes a central portion with a hole for receiving a fastener to secure the clamp to the cylinder head, and a pair of symmetrical crescent-shaped clamping forks forming a U-shaped opening to facilitate lateral sliding engagement with diametrically opposed flatted portions of corresponding fuel injectors. Each arm includes an arcuate pad that engages a corresponding shoulder of the fuel injector to provide an axial clamping force to the fuel injector. The distance between the distal ends of one fork and the semicircular portion of the opposite fork is selected to allow lateral sliding disengagement of the clamp from one of the adjacent injectors without rotation or removal of the other injector to facilitate servicing of individual injectors.

16 Claims, 5 Drawing Sheets

SYSTEM AND METHOD FOR SECURING FUEL INJECTORS

BACKGROUND

1. Technical Field

The present disclosure relates to a device for orienting and securing a fuel injector for an internal combustion engine.

2. Background Art

Various types of holding devices or clamps have been developed for use in internal combustion engines to secure fuel injectors in corresponding cylinders of the engine. Clamps may also provide angular orientation of each injector within the cylinder to properly position the injector spray pattern relative to the piston and inlet/exhaust ports. Injector clamps satisfy various requirements that may depend upon the particular application, such as providing a sufficient force to seal the injector against the combustion pressure and providing an axial force without significant bending or torsional forces. In addition, it is desirable to minimize the number of clamps and associated fasteners to reduce part count, engine weight, and cylinder head complexity, and to simplify initial assembly operations as well as any subsequent service operations.

One fuel injector clamp design has a separate clamp for each injector using a single bolt and a pivot end opposite the injector. This configuration directs only about one-half of the bolt force into the injector with the remaining portion loaded back into the cylinder head. Other designs use a single bolt to secure two adjacent injectors, but do not allow servicing of a single injector without entirely removing the clamp or, in some cases, require removing the clamp and both injectors. Various other clamp designs use two bolts per clamp, which may result in uneven clamping forces applied to the injector(s). Some prior art implementations require removal of the rocker cover to service the injectors.

SUMMARY

A system and method for securing fuel injectors in an internal combustion engine include a clamp for securing two adjacent injectors to a cylinder head of the engine. The clamp includes a central portion having a first thickness with a through hole having a spherical recess for receiving a fastener to secure the clamp to the cylinder head, and a pair of symmetrical crescent-shaped clamping forks each having two arms extending from a semi-circular base portion to form an arcuate U-shaped opening and having a second thickness to facilitate lateral sliding engagement with diametrically opposed flatted portions of corresponding fuel injectors to radially position or orient the fuel injectors. Each arm includes an arcuate pad or protuberance on its underside that engages a corresponding flat of the fuel injector to provide an axial downward clamping force to the fuel injector. The distance between the distal ends of one fork and the semicircular base portion of the opposite fork is selected to allow lateral sliding disengagement of the clamp from one of the associated injectors without rotation or removal of the other associated injector to facilitate servicing of individual injectors.

In one embodiment, a method for securing and orienting fuel injectors for an internal combustion engine includes installing a first fuel injector of an adjacent pair of injectors into a corresponding opening of a rocker arm cover and cylinder head, sliding one end of an injector clamp having a central mounting portion with diametrically opposed clamping forks to laterally engage the first one of the fuel injectors with a first one of the clamping forks, installing a second fuel injector of the adjacent pair of injectors, sliding the clamp toward the second injector such that a second fork of the injector clamp laterally engages the second injector, and fastening the mounting portion of the clamp through the rocker cover to the cylinder head to secure and orient the fuel injectors. The method may also include subsequently removing one fuel injector of a pair of clamped fuel injectors by removing the fastener from the mounting portion of the clamp and laterally sliding the clamp away from the injector to be removed without rotation of the other injector in the pair, such that the clamping fork disengages the injector to be removed.

The present disclosure includes embodiments having various advantages. For example, the systems and methods of the present disclosure provide a single clamp to secure and orient two adjacent injectors. The fork arms of the clamp provide accurate rotational or radial positioning of the injectors in the cylinder for proper injection jet pattern alignment. The fuel injectors, injector clamps, and bolts are installed and may be serviced without removing the rocker arm cover. A single clamp and bolt secures and orients two injectors such that fewer fasteners and parts are required, which reduces cost, weight, cylinder head complexity, and assembly time. The clamping pads provide an axial clamping force that is better aligned with the injector axis and lower contact stress at the clamp/injector interface. Lateral engagement of the clamps with the injectors below the fuel and electric couplings provides more efficient packaging for various engine components, such as the cylinder head sealing rail, oil drainbacks, glow plug access, etc. The injector clamps are also designed to facilitate manufacturing using a powdered metal forming process so that no machining operations are required.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a four-stroke, multi-cylinder, direct-injected compression-ignition internal combustion engine. Those of ordinary skill in the art may recognize similar applications or implementations with other engine/vehicle technologies.

Figure 1:
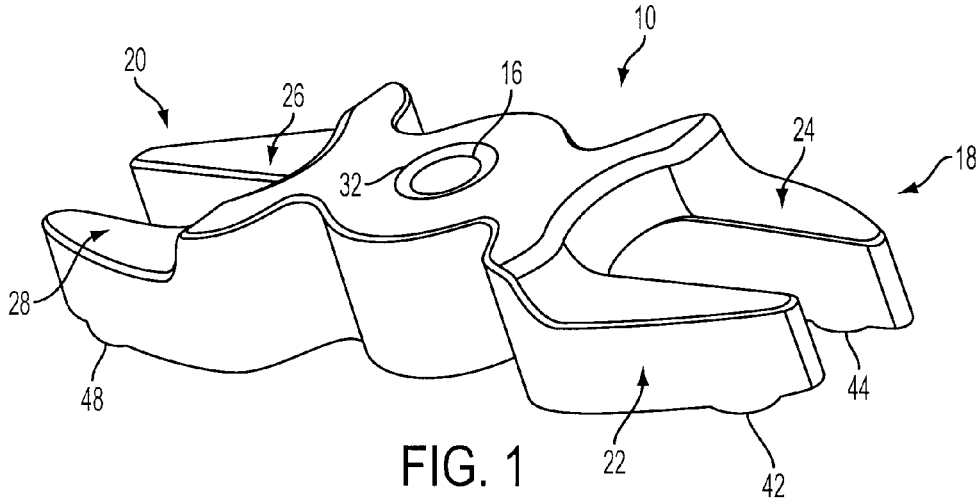
FIG. 1 is a perspective view of one embodiment of an injector clamp.
Figure 2:
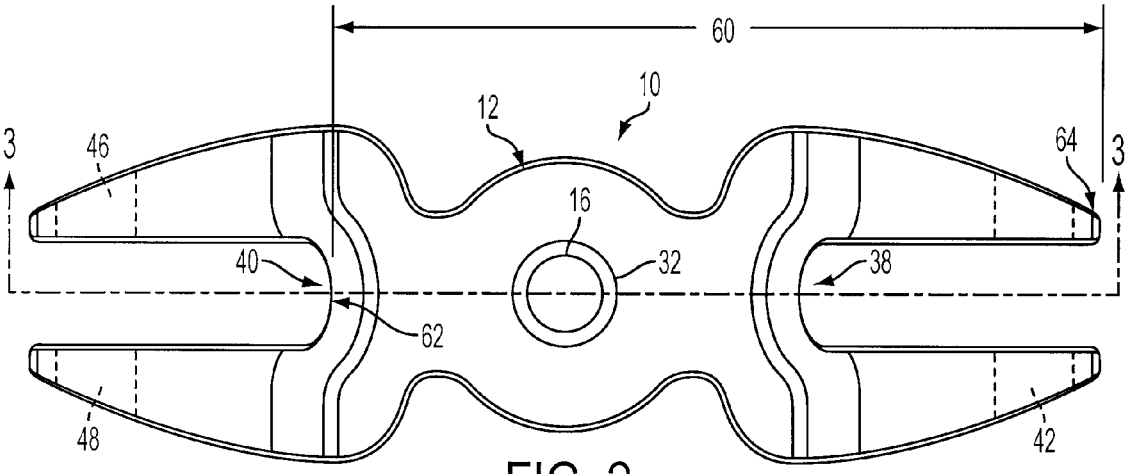
FIG. 2 is a top view of the injector clamp illustrated in FIG. 1.
Figure 3:
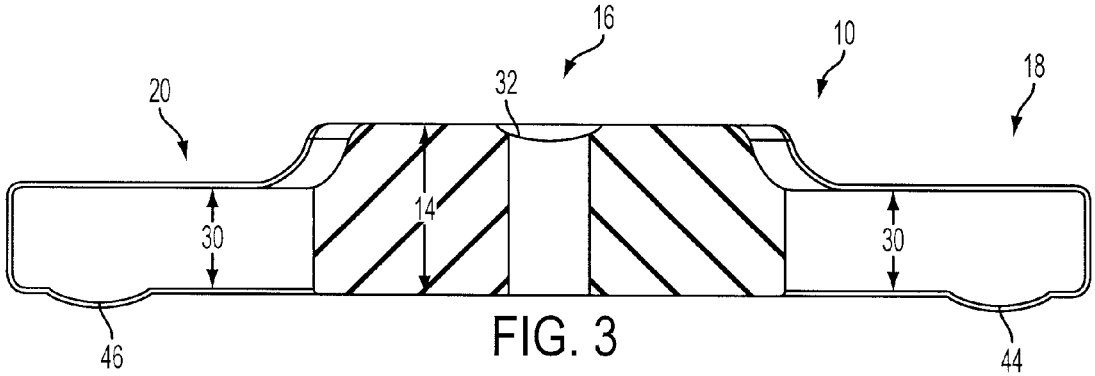
FIG. 3 is a cross-sectional view taken along line 3-3 of FIG. 2.

A representative embodiment of an injector clamp 10 for use in a system or method for securing injectors to an internal combustion engine is illustrated in FIGS. 1-3. Injector clamp 10 includes a central portion 12 having a first thickness 14 with a through hole 16 disposed within a spherical recess 32 for receiving a fastener to secure clamp 10 to a cylinder head (best illustrated in FIGS. 4, 7). Spherical recess 32 cooperates with a corresponding spherical portion of a fastener to reduce or eliminate any uneven loading on the fastener head that would otherwise be generated by variations in the seated height of adjacent fuel injectors. Clamp 10 includes a pair of forks 18, 20 diametrically opposed relative to hole 16 with each fork having two arms 22, 24 and 26, 28 of a second thickness 30 less than first thickness 14. Arms 22, 24 and 26, 28 extend from a respective arcuate or semi-circular base 38, 40 to form U-shaped openings or slots, best shown in the top view of FIG. 2. The U-shaped openings facilitate lateral sliding engagement with diametrically opposed flatted portions of adjacent fuel injectors as illustrated and described with reference to FIGS. 5-6. Likewise, clamp 10 is designed such that the distance 60 between an apex 62 of the U-shaped opening of one fork 20 and distal ends 64 of the arms of an opposite fork 18 is less than the distance between adjacent injectors in a clamping region so that clamp 10 can be laterally moved to disengage one of the adjacent fuel injectors while remaining engaged with the other adjacent injector to facilitate servicing of an individual injector without removing the clamp or adjacent injector, as best illustrated in FIG. 6. The reduced thickness 30 of forks 18, 20 relative to central portion 12 reduces the required fuel injector length and allows clamp 10 to engage the fuel injectors below the electrical connectors and fuel couplings to provide more efficient packaging, reduced material, and reduced weight as illustrated and described with reference to FIGS. 4-7. However, if there are no packaging constraints, forks 18, 20, in an alternative embodiment, could be the same thickness or even thicker than central portion 12.

In the embodiment illustrated in FIGS. 1-3, each arm 22, 24, 26, and 28 of clamp 10 includes an arcuate or radiused protuberance or pad 42, 44, 46, and 48, respectively, on its underside for applying a substantially axial clamping force to corresponding shoulders formed in the fuel injectors. In one embodiment, clamp 10 and pads 42, 44, 46, and 48 are integrally formed with a unitary construction using a powdered metal forming process so that subsequent machining operations are eliminated resulting in reduced manufacturing time and cost. The three-level design of clamp 10 with thicknesses 14, 30, and pads 42, 44, 46, 48, meets the structural requirements for providing a desired clamping force to the adjacent fuel injectors while reducing the mass of the clamp relative to similarly shaped clamps having a single thickness or one-level design.

Figure 4:
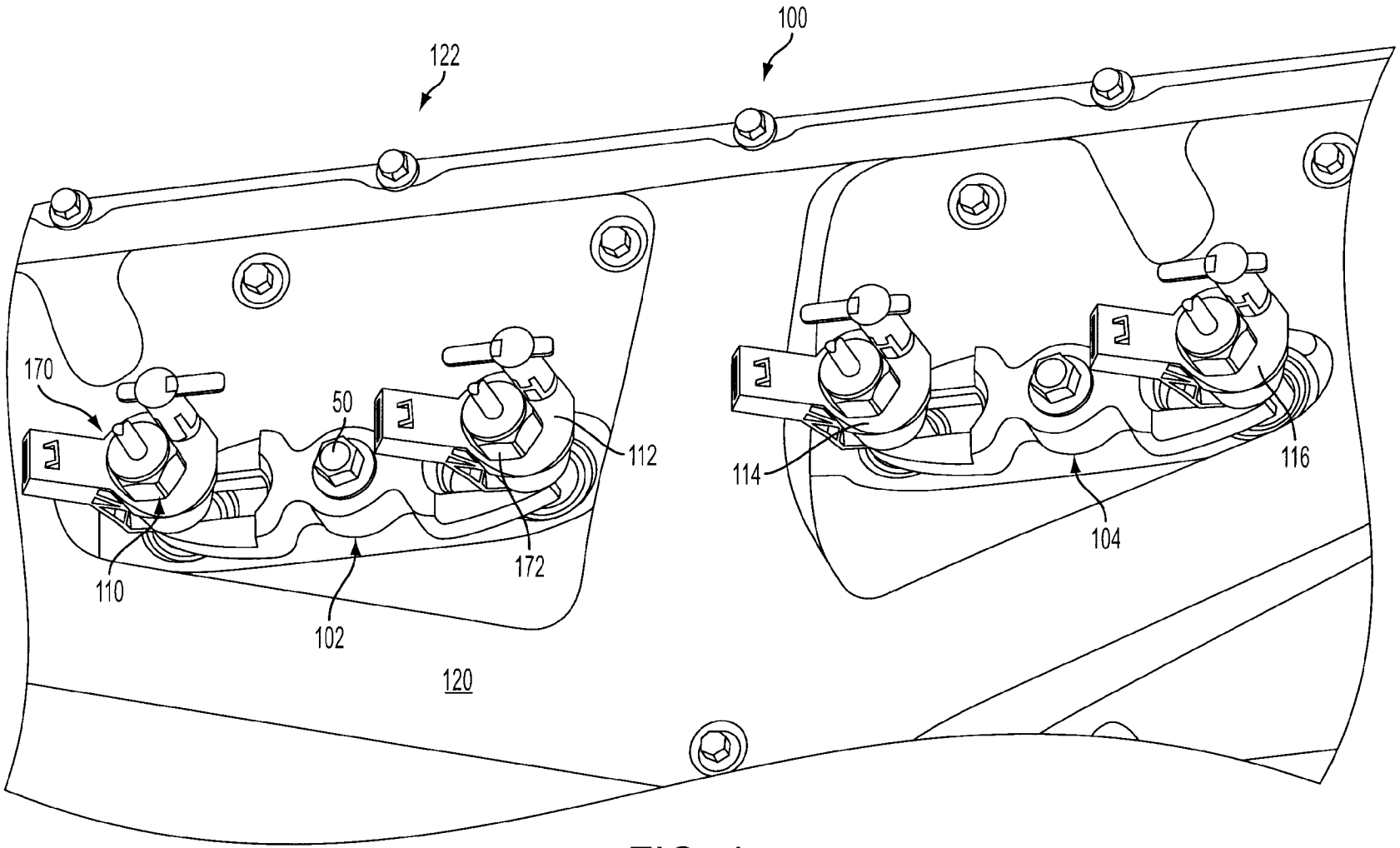
FIG. 4 is a perspective view of the top portion of an internal combustion engine having fuel injector clamps according to one embodiment.
Figure 5:
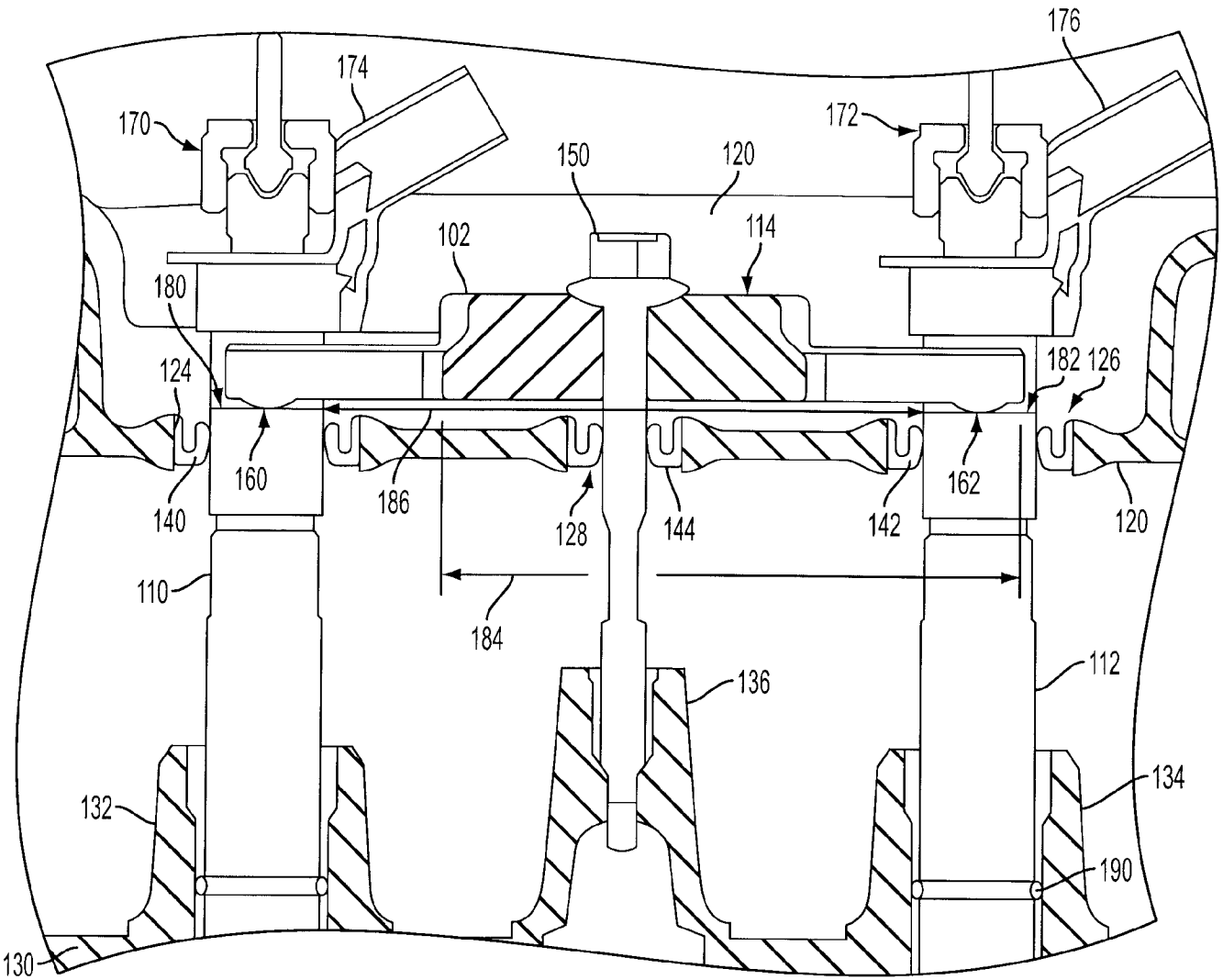
FIG. 5 is a partial cross-sectional view of an internal combustion engine illustrating an injector clamp securing adjacent injectors to a cylinder head through a rocker arm cover according to one embodiment.
Figure 6:
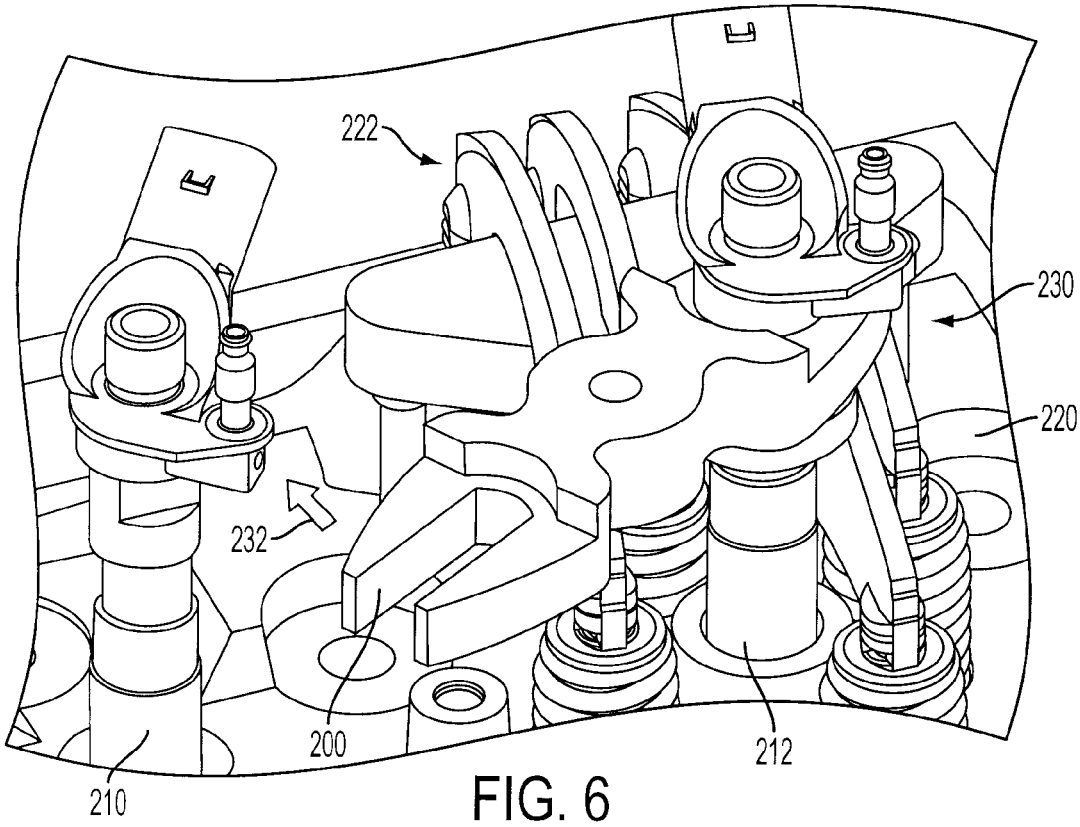
FIG. 6 is a perspective view of the top portion of an internal combustion engine illustrating a method of installing injector clamps according to one embodiment.

A system for securing fuel injectors within corresponding cylinders of an internal combustion engine according to one embodiment of the present disclosure is illustrated in the perspective view of FIG. 4 and cross-sectional view of FIG. 5. The top portion of an internal combustion engine 100 having two injector clamps 102, 104 for securing adjacent fuel injectors 110, 112 and 114, 116, respectively, according to the present disclosure is illustrated in FIG. 4. Rocker arm cover 120 is secured to a cylinder head 130 (FIG. 5) by a plurality of fasteners, represented generally by reference numeral 122. Rocker arm cover 120 includes a through hole 124, 126 for each injector 110, 112, and a through hole 128 for each injector clamp 102, 104. Seals 140, 142, 144 may be used to contain lubricating oil between rocker arm cover 120 and cylinder head 130.

As shown in FIG. 5, cylinder head 130 includes bosses 132, 134 that define corresponding injector apertures or holes that align with corresponding holes in rocker cover 120 so that fuel injectors 110, 112 extend into corresponding cylinders of internal combustion engine 100. Cylinder head 130 also includes a mounting boss 136 for each injector clamp 102 that aligns with a corresponding hole 128 in rocker cover 120. After installation and orientation of injectors 110, 112 as described with reference to FIGS. 6-8, fastener 150 extends through the hole in central portion 114 of clamp 102, and through hole 128 and seal 144 to engage a threaded portion of boss 136 and secure injectors 110, 112 to cylinder head 130. Injector clamp 102 laterally engages adjacent injectors 110, 112 below fuel couplings 170, 172 and electrical connectors 174, 176, respectively, and above rocker arm cover 120. Clamping pads 160, 162 on the underside of corresponding arms of clamp 102 engage respective shoulders 180, 182 formed by flatted portions in a generally cylindrical region of fuel injectors 110, 112 to apply a substantially axial clamping force to injectors 110, 112 and secure injectors 110, 112 to cylinder head 130. As previously described, the distance 184 between an apex of the base of one fork and the ends of the opposite fork is less than the distance 186 between adjacent injectors 110, 112 at the axial position of the flatted shoulders of the injectors to allow lateral sliding disengagement of the clamp from one of the injectors (after removal of fastener 150) to facilitate servicing of an individual injector without rotating or removing the adjacent injector, which could otherwise require replacement of one or more injector seals on the injector that is not being serviced.

In the embodiment illustrated in FIGS. 4 and 5, injector clamp 102 engages adjacent fuel injectors 110, 112 above rocker arm cover 120 and below fuel couplings 170, 172, which are connected to a common rail fuel distribution system (not shown). As described above, clamps 102, 104 may be laterally disengaged from either one of their associated adjacent fuel injectors for servicing/removal of an individual injector by removing fastener 150 and sliding toward the other injector so that the disengaged injector may be serviced without removing rocker cover 120, and without removing the clamp or the other fuel injector. Lateral engagement of the injectors with forks having a reduced thickness relative to the central portion of the clamp allows the clamp to be installed above the rocker arm cover while providing efficient packaging and reducing material and weight.

Figure 7:
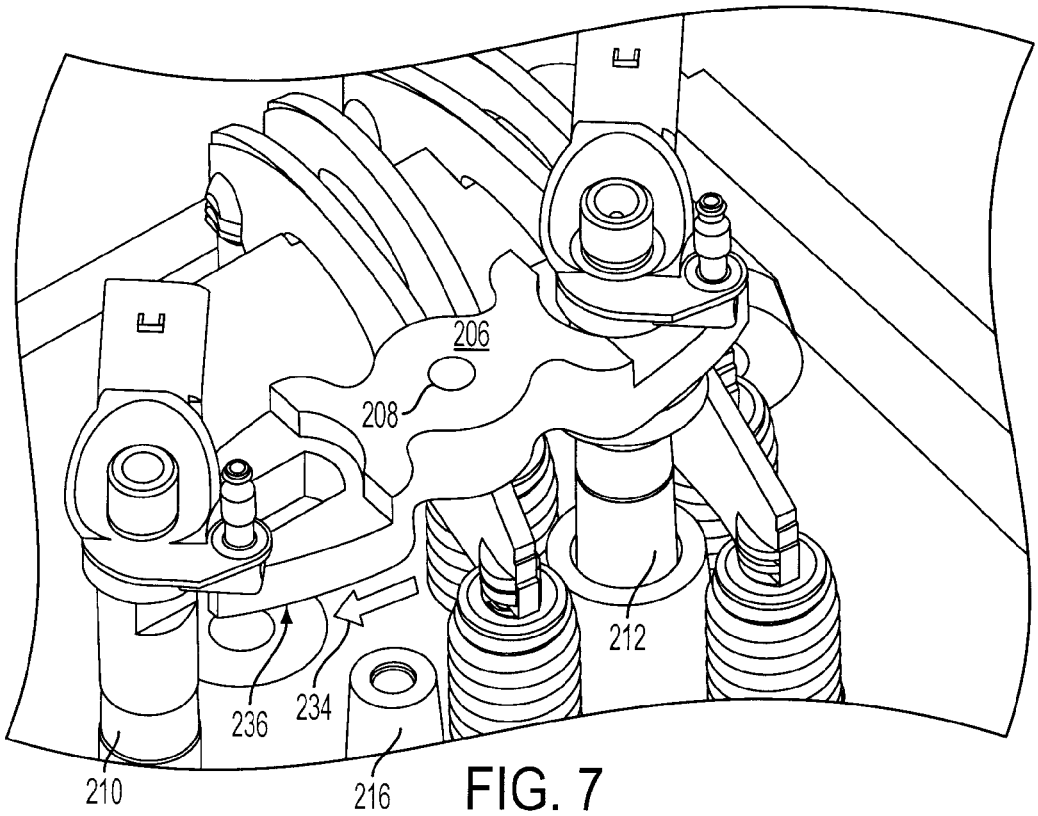
FIG. 7 is a perspective view of the top portion of an internal combustion engine illustrating a method of installing and/or removing injector clamps according to one embodiment.

FIGS. 6-7 provide a perspective view of the top portion of an internal combustion engine to illustrate alternative embodiments of a method for orienting and securing a plurality of fuel injectors according to one embodiment of the present disclosure. The perspective views of FIGS. 6-7 have the rocker cover 120 (FIG. 4) removed to better illustrate positioning of injector clamp 200 and adjacent fuel injectors 210, 212 relative to cylinder head 220 and intake/exhaust valve rocker arms and associated actuating hardware 222 disposed beneath the rocker arm cover.

In one embodiment illustrated in FIG. 6, after the rocker arm cover is secured to cylinder head 220, injectors 210, 212 are installed into corresponding opening of the rocker arm cover and cylinder head 220, as also illustrated in the embodiment of FIG. 5. Injector clamp 200 is installed by sliding one end into lateral engagement with diametrically opposed flatted portions of fuel injector 212. Clamp 200 is moved in the direction of arrow 232, which rotates injector 212 about its axis to orient injector 212 within its associated cylinder, until the other end of clamp 200 is aligned with the flatted portions of injector 210 as illustrated in FIG. 7. Clamp 200 is then moved in the direction of arrow 234, generally transverse to the longitudinal axes of injectors 210, 212, so the second fork laterally engages injector 210 and rotationally orients injectors 210, 212 relative to one another. Through hole 208 in central mounting portion 206 is aligned with a corresponding hole in the rocker cover (FIGS. 4, 5) and boss 216 of cylinder head 220. A fastener (50, FIGS. 4-5) is then installed in hole 208 and engages threads in boss 216 to apply a substantially axial clamping force to injectors 210, 212 that secures and orients the fuel injectors relative to cylinder head 220. While this method may be suitable for many applications, it is generally desirable to minimize or eliminate rotation of injectors within the bore during assembly/installation or subsequent servicing. As such, an injector clamp according to the present disclosure facilitates a preferred alternative method of assembly/servicing of injectors that reduces or eliminates rotating the seated injector as described below.

In a preferred embodiment for installation/assembly of injectors that reduces or eliminates rotating the injectors, the injectors are installed one at a time so the rotation of FIG. 6 is reduced or eliminated. Using this method, one of the injectors 210, 212 is oriented and installed into a corresponding opening of the rocker arm cover and cylinder head 220. Injector clamp 200 is then installed by sliding one end into lateral engagement with diametrically opposed flatted portions of the installed injector. The other injector of the adjacent pair is then oriented and installed with clamp 200 moved in the direction of arrow 234 of FIG. 7, generally transverse to the longitudinal axes of injectors 210, 212 so the second fork laterally engages injector 210 and through hole 208 is aligned with a corresponding hole in the rocker cover and boss 216 of cylinder head 220. A fastener is then installed as previously described to secure the injector pair to the cylinder head. While some minor rotational positioning may be required to align injectors 210, 212 with clamp 200, the rotation is significantly reduced relative to the method illustrated in FIG. 6.

After installation of clamp 200, an individual one of a pair of adjacent injectors may be removed for servicing without removal of the rocker cover or clamp 200, and without rotating or removing the non-serviced injector of the pair to reduce or eliminate the necessity for replacing one or more seals on the non-serviced injector. Removal of one of the injectors of an adjacent pair, such as injector 210, includes removing an associated fastener from hole 208 and laterally sliding clamp 200 toward injector 212 and away from injector 210 until fork 236 disengages injector 210. Clamp 200 can be disengaged from either injector 210 or 212 without rotating either injector to reduce or eliminate the potential of damaging any seals associated with the non-serviced injector. After sliding the clamp away from injector 210, the injector may be removed from the cylinder head and rocker arm cover while the opposite fork of clamp 200 remains engaged with injector 212.

Figure 8:
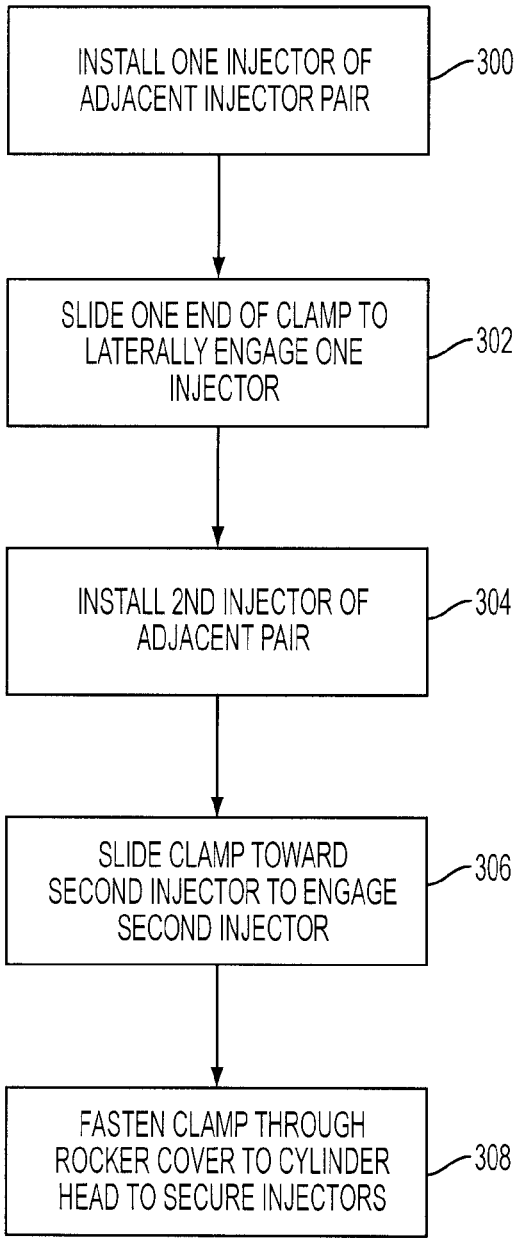
FIG. 8 is a diagram illustrating a method for orienting and securing fuel injectors for an internal combustion engine.

FIG. 8 is a process diagram providing an alternative representation of a preferred method for securing and orienting a plurality of generally cylindrical fuel injectors each having a flatted portion disposed below a fuel coupling in an internal combustion engine having a rocker arm cover extending over intake/exhaust valve operating apparatus and secured to a cylinder head according to one embodiment of the present disclosure. As represented by block 300, the method includes installing one injector of an adjacent pair into a corresponding opening of the rocker arm cover and cylinder head. The method continues with sliding an injector clamp having a central mounting portion with diametrically opposed clamping forks so that one fork laterally engages the installed fuel injector as represented by block 302. The second injector of the adjacent pair is then installed into a corresponding opening of the rocker arm cover and cylinder head as represented by block 304. The method continues with sliding the clamp toward the second injector such that the second fork of the clamp laterally engages the second injector and the mounting hole in the central portion of the clamp is aligned with a corresponding hole in the rocker cover and cylinder head boss as indicated by block 306. The clamp and adjacent injectors are secured to the cylinder block by fastening the central mounting portion of the clamp through the rocker cover to the cylinder head to secure and orient the two adjacent fuel injectors as represented by block 308.

Figure 9:
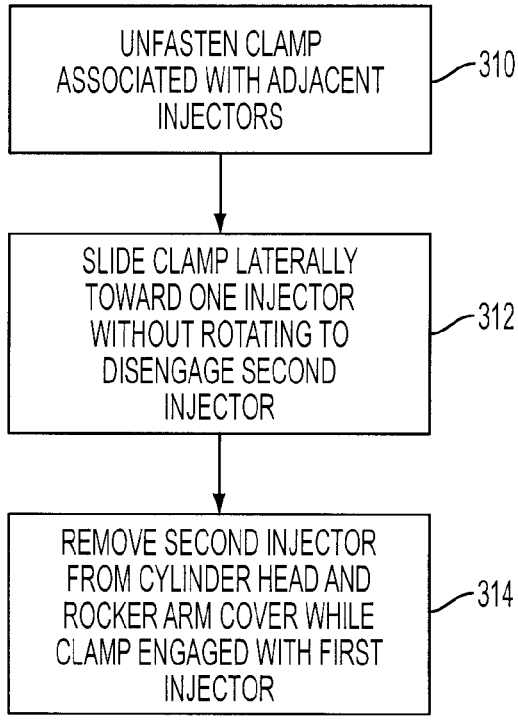
FIG. 9 is a diagram illustrating a method for removing a fuel injector secured using a clamp according to the present disclosure for servicing after assembly.

A method for removing or servicing an injector is illustrated in the diagram of FIG. 9. The method includes the steps represented by blocks 310-314 to facilitate servicing a single fuel injector of an adjacent pair of injectors having a common injector clamp. The method includes unfastening the mounting portion of the clamp associated with two adjacent injectors as represented by block 310 and sliding the clamp laterally without rotating toward a first one of the adjacent injectors to disengage the fork from the second one of the adjacent injectors as represented by block 312. After disengaging the clamp from one of the injectors, the method may include removing the other fuel injector from the cylinder head and rocker arm cover while one of the clamp forks remains engaged with the first fuel injector as represented by block 314.

As illustrated and described above, systems and methods of the present disclosure provide a single clamp to secure and orient two adjacent injectors and allow the injector clamps to be installed after the rocker arm cover. The fork arms of the clamps provide accurate rotational or radial positioning of the injectors in the cylinder for proper injection jet pattern alignment. The fuel injectors, injector clamps, and bolts are installed and may be serviced without removing the rocker arm cover. A single clamp and bolt secures and orients two injectors such that fewer fasteners and parts are required, which reduces cost, weight, cylinder head complexity, and assembly time. The clamping pads provide an axial clamping force that is better aligned with the injector axis and lower contact stress at the clamp/injector interface. Lateral engagement of the clamps with the injectors below the fuel and electric couplings provides more efficient packaging for various engine components, such as the cylinder head sealing rail, oil drainbacks, glow plug access, etc. The injector clamps are also designed to facilitate manufacturing using a powdered metal forming process so that no machining operations are required.

While the best mode has been described in detail, those familiar with the art will recognize various alternative designs and embodiments within the scope of the following claims. Several embodiments have been compared and contrasted. Some embodiments have been described as providing advantages or being preferred over other embodiments in regard to one or more desired characteristics. However, as one skilled in the art is aware, one or more characteristic may be comprised to achieve desired system attributes, which depend on the specific application. These attributes include, but are not limited to: cost, strength, durability, life cycle cost, marketability, appearance, packaging, size, serviceability, weight, manufacturability, ease of assembly, etc. The embodiments discussed herein that are described as inferior to another embodiment with respect to one or more characteristics are not outside the scope of the invention.

What is claimed:

1. A system for securing adjacent fuel injectors of an internal combustion engine, the system comprising:

an injector clamp having a central portion of a first thickness with a hole for receiving a fastener to secure the clamp to a cylinder head, the clamp including a pair of forks diametrically opposed relative to the hole, each fork having two arms extending from a semi-circular base to form a U-shaped opening for lateral sliding engagement with diametrically opposed flatted portions of adjacent fuel injectors; and a rocker arm cover fastened to the cylinder head and having a through hole for each injector clamp, wherein the central portion of the injector clamp is secured to the cylinder head by a fastener extending through the hole in the clamp and the hole in the rocker cover, and wherein injector clamp forks engage adjacent injectors above the rocker arm cover at a distance such that the injector clamp does not contact the rocker arm cover.

2. The system of claim 1 wherein the cylinder head includes a boss having a hole for receiving the fastener, which extends through the hole of the injector clamp, to secure the injector clamp to the cylinder head.

3. The system of claim 1 wherein the injector clamp comprises a clamping pad on an underside of each arm of each fork for applying a substantially axial clamping force to each injector.

4. The system of claim 3 wherein the clamping pad comprises an arcuate protuberance integrally formed of unitary construction with the clamp.

5. The system of claim 1 wherein the injector clamp is integrally formed with a unitary construction using a powdered metal forming process.

6. The system of claim 1 wherein distance between an apex of the U-shaped opening of one fork and distal ends of the arms of an opposite fork of the clamp is less than distance between adjacent injectors in a clamping plane so that the clamp can be laterally moved to disengage one of the adjacent injectors while remaining engaged with the flatted portions of the other one of the adjacent injectors.

7. The system of claim 1 wherein the arms of each fork have a second thickness less than the first thickness.

8. A system for securing fuel injectors within corresponding cylinders of an internal combustion engine, the system comprising:

a cylinder head having a fuel injector hole for each cylinder and one injector mounting boss for each distinct pair of cylinders with the mounting boss substantially centered between adjacent injectors;

a rocker arm cover secured to the cylinder head and including a plurality of holes corresponding to, and aligned with, the fuel injector holes and injector mounting bosses of the cylinder head;

a plurality of fuel injectors each extending through the rocker cover into a corresponding fuel injector hole of the cylinder, each fuel injector including a generally cylindrical portion with diametrically opposed flatted shoulders disposed above the rocker arm cover and below a fuel coupling; and an injector clamp disposed between adjacent fuel injectors, the clamp having a central portion with a through hole for securing the clamp to the cylinder head and diametrically opposed forks extending from the central portion, each fork including two arms extending from a semi-circular base to form a U-shaped opening that engages a vertical portion of the flatted shoulders of an associated fuel injector to radially orient the fuel injector relative to the clamp, each arm having an underside with an arcuate clamping pad that contacts a corresponding shoulder of the associated fuel injector to apply a substantially axial clamping force to secure the injector to the cylinder head.

9. The system of claim 8 wherein the central portion of the injector clamps is disposed above the rocker arm cover without contacting the rocker arm cover.

10. The system of claim 8 wherein the distance from the apex of one U-shaped opening to a distal end of the arms defining an opposite U-shaped opening of the clamp is less than the distance between adjacent injectors measured at the axial position of the flatted shoulders so that the clamp may be laterally disengaged from one of the injectors of an adjacent pair of injections by sliding toward the other injector of the adjacent pair.

11. The system of claim 8 wherein the injector claim includes a central portion having a first thickness and diametrically opposed forks having a second thickness less than the first thickness.

12. The system of claim 8 wherein the injector clamp is formed using a powdered metal process.

13. The system of claim 8 wherein the internal combustion engine comprises a compression-ignition engine with a common rail fuel distribution system with high-pressure fuel delivered to each fuel injector through the fuel coupling.

14. A method for securing and orienting a plurality of generally cylindrical fuel injectors each having a flatted portion disposed below a fuel coupling in an internal combustion engine having a rocker arm cover extending over intake/exhaust valve operating apparatus and secured to a cylinder head, the method comprising:

installing one fuel injector of an adjacent fuel injector pair into a corresponding opening of the rocker arm cover and cylinder head;

sliding one end of an injector clamp having a central mounting portion with diametrically opposed clamping forks to laterally engage the installed fuel injector of the adjacent fuel injector pair with a first one of the clamping forks;

installing a second fuel injector of the adjacent fuel injector pair into a corresponding opening of the rocker arm cover and cylinder head;

sliding the clamp toward the second fuel injector such that the second fork of the clamp laterally engages the second fuel injector; and fastening the mounting portion of the clamp through the rocker cover to the cylinder head to secure and orient the fuel injectors.

15. The method of claim 14 further comprising:

unfastening the mounting portion of the clamp associated with two adjacent injectors; and sliding the clamp laterally without rotating toward a first one of the adjacent injectors to disengage the fork from the second one of the adjacent injectors.

16. The method of claim 15 further comprising:

removing the second fuel injector from the cylinder head and rocker arm cover with one of the clamp forks engaged with the first fuel injector.

* * * * *